US007699183B2

(12) United States Patent
Matsuoka et al.

(10) Patent No.: US 7,699,183 B2
(45) Date of Patent: Apr. 20, 2010

(54) SQUARE BOTTLE MANUFACTURED FROM SYNTHETIC RESIN

(75) Inventors: Kenshi Matsuoka, Tokyo (JP); Ryoichi Tomishima, Urayasu (JP); Satoshi Kuboi, Kawasaki (JP); Toshimasa Tanaka, Tokyo (JP); Tadashi Hayakawa, Matsudo (JP); Takao Iizuka, Tokyo (JP)

(73) Assignees: The Coca-Cola Company, Atlanta, GA (US); Yoshino Kogyosho, K.K., Tokyo (JP)

( * ) Notice: Subject to any disclaimer, the term of this patent is extended or adjusted under 35 U.S.C. 154(b) by 0 days.

(21) Appl. No.: 11/761,785

(22) Filed: Jun. 12, 2007

(65) Prior Publication Data

US 2008/0245762 A1 Oct. 9, 2008

Related U.S. Application Data

(63) Continuation of application No. 11/697,799, filed on Apr. 9, 2007, now abandoned.

(51) Int. Cl.
*B65D 1/02* (2006.01)

(52) U.S. Cl. ..... 215/383; 215/381; 220/675

(58) Field of Classification Search ..... 215/379, 215/381, 382, 384, 900; 220/666, 669, 675
See application file for complete search history.

(56) References Cited

U.S. PATENT DOCUMENTS

| | | | | |
|---|---|---|---|---|
| 5,064,081 | A * | 11/1991 | Hayashi et al. | 215/373 |
| 5,381,910 | A * | 1/1995 | Sugiura et al. | 215/398 |
| 2006/0108317 | A1* | 5/2006 | Tanaka et al. | 215/382 |
| 2008/0041811 | A1* | 2/2008 | Stowitts | 215/381 |
| 2008/0041812 | A1* | 2/2008 | Stowitts | 215/384 |

FOREIGN PATENT DOCUMENTS

JP 2002-590084 B2 8/1988

OTHER PUBLICATIONS

Abstract of JP 2002-590084 B2.

* cited by examiner

*Primary Examiner*—Sue A Weaver
(74) *Attorney, Agent, or Firm*—Finnegan, Henderson, Farabow, Garrett & Dunner, LLP

(57) ABSTRACT

Disclosed herein are bottle-shaped containers having a trunk portion approximating a square. The trunk portion comprises four tabular side walls arrayed about a center axis and four corner walls connected to adjacent side walls in a corner-cutting form. The width of the corner walls expands from the top end and the bottom end toward a position about midway between the top end and the bottom end. By making the widths of the side walls and the corner walls about equal at a location about midway between the top portion and the bottom portion, the distance between the corner walls in mutual opposition with respect to the center axis can be decreased, forming a waist portion.

17 Claims, 5 Drawing Sheets

SQUARE BOTTLE MANUFACTURED FROM SYNTHETIC RESIN

CROSS-REFERENCE TO RELATED APPLICATIONS

This application is a continuation of Ser. No. 11/697,799, filed Apr. 9, 2007 now abandoned, which is herein incorporated by reference in its entirety.

TECHNICAL FIELD

Disclosed herein are bottle-shaped containers and methods of their production and use.

BACKGROUND

In previous square bottles, the width of the corner portions was approximately fixed in the vertical direction. Those corner walls functioned as pillars to hold the bottle rigid. Even when the interior of the bottle was in a somewhat decompressed state, those corner walls suppressed the deformations.

When the width of corner walls is expanded from the top-end portion and the bottom-end portion toward approximately the mid-height position, the function of preserving rigidity with respect, especially, to a bottle flattening deformation of such corner walls declines; the corner walls themselves deform in even a relatively low decompression state, and there is a tendency for visually prominent deformations such as flattening of the bottle shape to occur.

For example, Japanese Laid Open Patent 2590084 discloses a square bottle manufactured from synthetic resin (referred to below as simply a "square bottle"), being an approximately square tube wherein a trunk portion comprises four side walls and four corner walls positioned between the side walls, in which decompression absorption panels are formed in the side walls. These panels function to uniformly absorb decompression, so that deformations caused by negative pressure when the interior is decompressed are not visually prominent.

SUMMARY

One aspect disclosed herein relates to a novel bottle-shaped container, whose shape is capable of imparting an overall impression of slimness while maintaining the external appearance and functionality of a square-shaped bottle. This container provides a previously unavailable differentiated square bottle.

In an embodiment, a bottle-shaped container having four tabular side walls and four corner walls may be formed by expanding the width of the corner walls from the top end and bottom end toward a position at approximately the center height, and by forming a waist portion by shrinking the distance between two corner walls in mutual opposition with respect to a center axis. The resulting container exhibits an overall slim feeling while maintaining the visual appearance and functionality of a square bottle.

In yet another embodiment, the square bottle-shaped container may be manufactured from synthetic resin. The container may comprise an approximately square trunk portion formed from four tabular side walls arrayed about a center axis and four corner walls connected to the adjacent side walls in a corner-cutting shape. The width of each corner wall expands from a top end of the trunk portion and a bottom end of the trunk portion toward the approximately mid-height position. The width of each side wall and each corner wall is about equal at a position about halfway between the top end and the bottom end. Thus, the distance between two mutually opposing corner walls with respect to the center axis decreases, forming a waist portion. In addition to imparting a slim feeling, the waist portion, depending on the viewing angle, presents an overall square bottle appearance with a differentiated appearance.

The portions above and/or below the waist portion can also have the same shape as previous square bottles and can be handled in the same way as previous square bottles in conveyor lines, carton packaging lines, vending machines and the like. Those portions can also impart favorable gripping characteristics through the waist portion.

In yet another embodiment, a bottle-shaped container disclosed herein further comprises vertically long decompression absorption panels surrounding the perimeter by a step portion. In an embodiment, the height of those panels approximate about the full height range of the side walls. The decompression absorption panels may be arrayed around the center axis. These decompression absorption panels are configured to suppress large and irregular deformations occurring in the decompressed state.

In yet another embodiment, the bottle-shaped container is configured for use in a large decompression state. The bottle comprises concave portions configured to serve as the starting point for caving deformation when the bottle interior is decompressed. These concave portions are located at a position at the center of the decompression absorption panels in the horizontal direction over approximately the full height range of the decompression absorption panels. In a further embodiment, the caving deformations are limited to decompression absorbing panels.

By first disposing decompression absorption panels to about the full height range of the side walls, a decompression absorption function can be achieved by the resulting large surface area. By forming a concave portion that serves as the starting point for caving deformation during decompression, the decompression absorption panel is capable of undergoing a caving deformation in a horizontally symmetrical and uniform manner over the full height range. Deformation does not spread to the corner walls, thereby enabling any deformation occurring to be restricted to the decompression absorption panels formed in the side walls.

In another embodiment, the bottle-shaped container further comprises at least one horizontal rib configured to suppress outward swelling deformations of the decompression absorption panels. The horizontal rib facilitates a universal deformation over the decompression absorption panels.

In a further embodiment wherein the bottle-shaped container comprises at least one horizontal rib, the concave portion may not traverse the full height of the decompression absorption panel. In an embodiment, the portion above the waist portion excludes a concave portion. In another embodiment, the portion below the waist portion excludes a concave portion. In yet another embodiment, both portions below and above the waist portion exclude a concave portion.

The skilled artisan may readily determine a shape for the concave portion of the bottle-shaped containers disclosed herein. The shape design may be a function of external appearance, decompression absorption function, and the suppressing effect of the shape design on swelling deformations when the temperature of the container contents rises in a filled and sealed state. In one embodiment, the shape design may be a vertical channel shape. In another embodiment, the shape design may be a vertically long oval shape. In yet another embodiment, the shape design may be a vertically long diamond shape. In further embodiments, the shape design may be other shapes as determined by a skilled artisan.

In a further embodiment, the bottle-shaped container also comprises an outwardly curving corner wall shape. When viewed in a planar cross-section, this shape approximates a convex curve. This shape coupled with the effect of forming a concave portion in the decompression absorption panel enables more reliable absorption of deformation during decompression, restricting deformation to the decompression absorption panels formed in the side walls.

In yet another embodiment, the bottle-shaped container further comprises a concave portion above the waist portion and a concave portion below the waist portion. The concave portion is divided at the waist portion between upper and lower portions in the vertical direction. A large degree of freedom can be provided to the caving deformation of the decompression absorption panel, thus permitting a fuller realization of the decompression absorption function.

Embodiments consistent with those disclosed herein are useful for storing products as juice, drinking water, tea, and the like. Because those liquids are produced by a high temperature, the filling process occurs at a temperature above room temperature. In an embodiment, the liquid is heated before or during the step of filling at a temperature ranging from about 80° C. to about 90° C. Following the step of filling, the container may be sealed with a closure mechanism. In an embodiment, the closure mechanism is a cap. In another embodiment, the closure mechanism is a flip top. Under these elevated temperature conditions, the bottle-shaped containers are in a high state of decompression once cooled to room temperature.

It is to be understood that both the foregoing general description and the following detailed description are exemplary and explanatory only and are not restrictive of the embodiments, as claimed.

The accompanying drawings, which are incorporated in and constitute a part of this specification, illustrate several embodiments and together with the description serve to explain the principles disclosed herein.

BRIEF DESCRIPTION OF THE DRAWINGS

FIG. 1(*b*) depicts a side view from the diagonal direction of the bottle depicted in FIG. 1(*a*).

FIG. 2(*b*) depicts a planar cross-sectional view along the line A-A of the bottle depicted in FIG. 1(*a*).

FIG. 4(*b*) depicts a planar cross-sectional view along the line B-B of the bottle depicted in FIG. 3.

FIG. 4(*c*) depicts a planar cross-sectional view along the line C-C of the bottle depicted in FIG. 3.

DESCRIPTION OF THE EMBODIMENTS

Reference will now be made in detail to the exemplary embodiments of the invention, examples of which are illustrated in the accompanying drawings. Wherever possible, the same reference numbers will be used throughout the drawings to refer to the same or like parts.

Figure 1A:
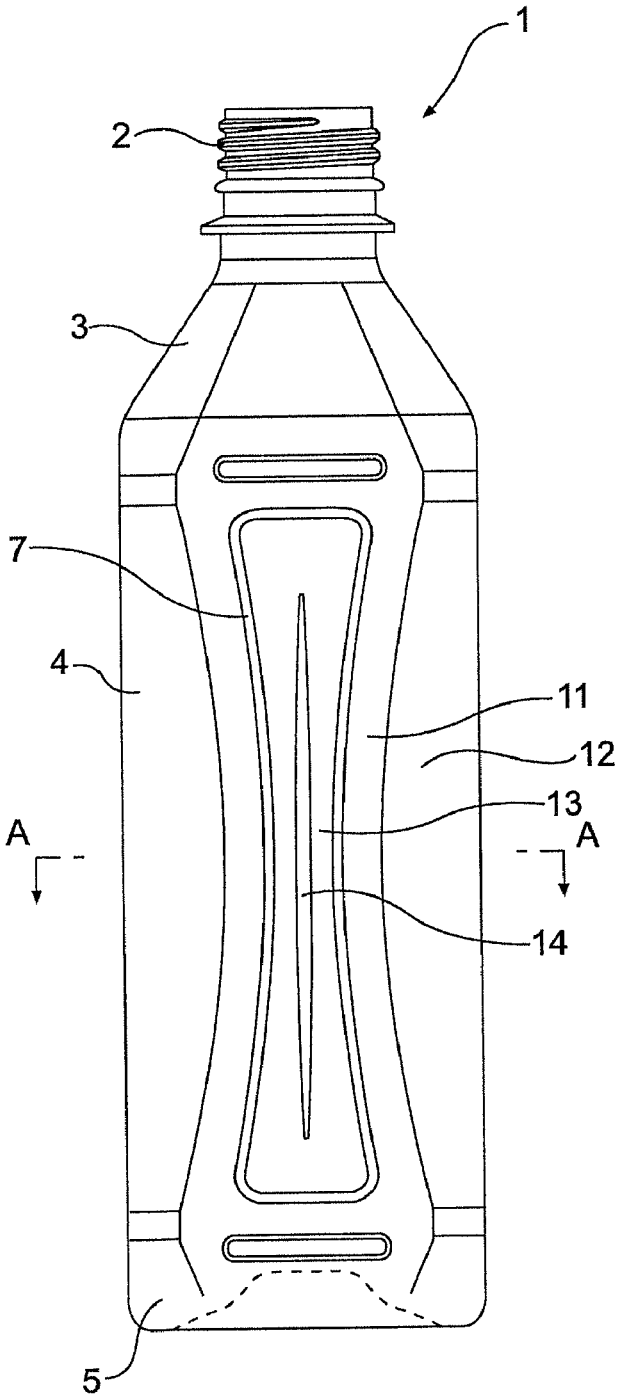
FIG. 1(*a*) depicts a front view of a bottle consistent with the embodiments disclosed herein.
Figure 1B:
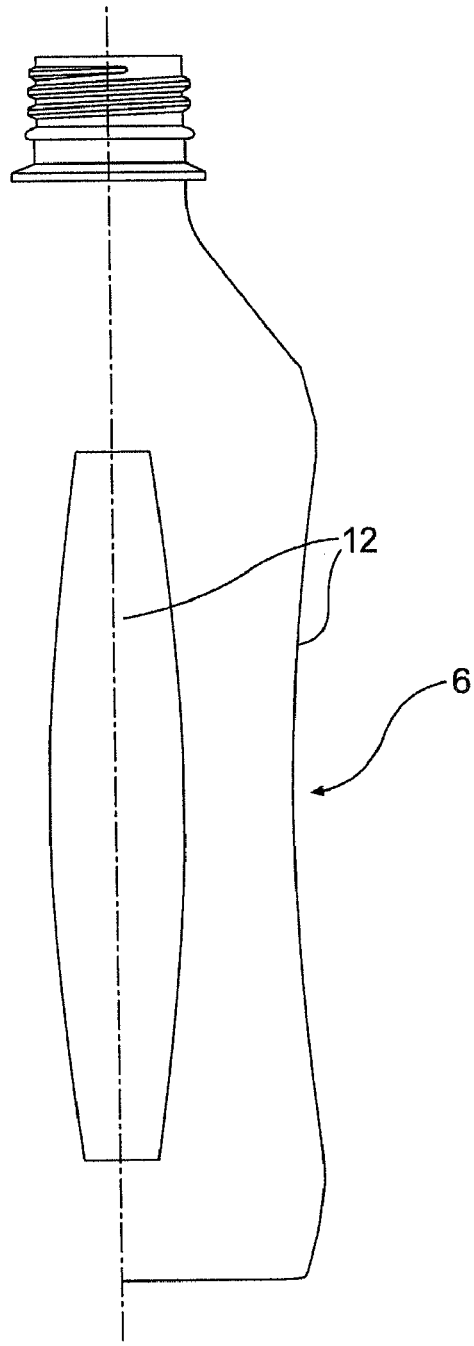
Figure 2A:
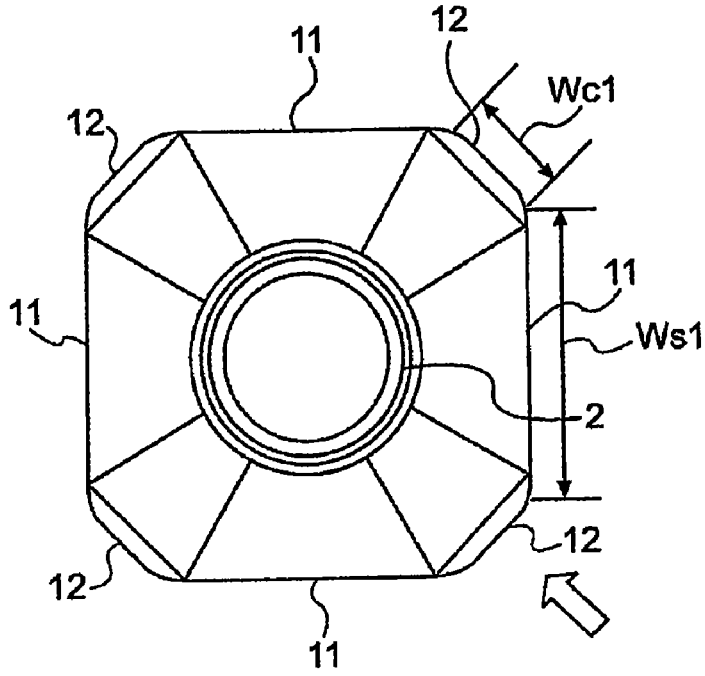
FIG. 2(*a*) depicts a plan view of the bottle depicted in FIG. 1(*a*).
Figure 2B:
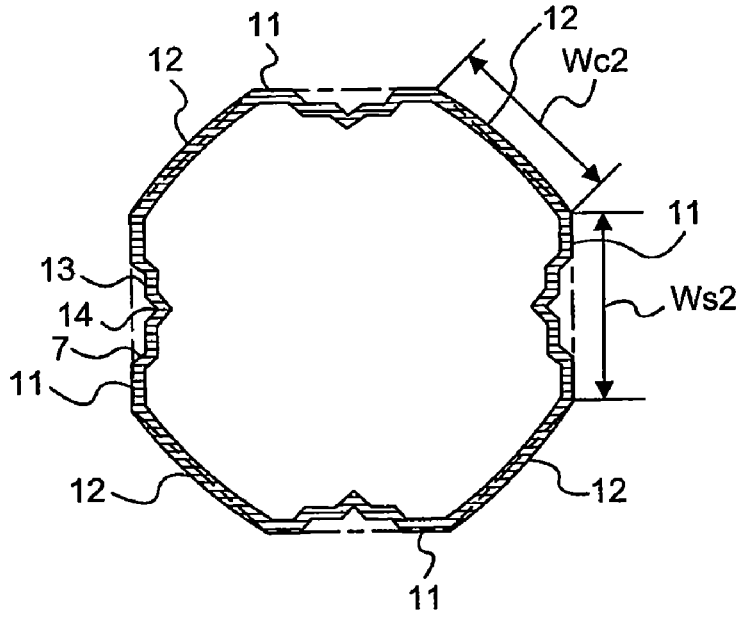

FIGS. 1 and 2 illustrate an embodiment of a square bottle-shaped container 1 consistent with the embodiments disclosed herein. In an embodiment, square bottle-shaped container 1 may be a bi-axially oriented blow molded bottle. Bottle 1 may comprise a mouth portion 2, a shoulder portion 3, a trunk portion 4, and a bottom portion 5.

Mouth portion 2 may comprise an orifice configured to receive and dispense liquid contained within bottle 1. Mouth portion 2 may further comprise a helical protrusion on the circumference configured to complement a helical protrusion on a closure. Shoulder portion 3 comprises a wall expanding from a first diameter to a second diameter.

Trunk portion 4 may be configured as a square tube having four tabular side walls 11 disposed along a center axis and four corner walls 12 connected to the appropriate tabular side wall 11 adjacent to corner wall 12. Corner wall 12 may be connected to tabular side wall 11 in a corner-cutting form.

The width of each corner wall 12 in square bottle-shaped container 1 expands from the top end and from the bottom end toward the approximately center height position of trunk portion 4 (see FIG. 1(*b*) and FIGS. 2(*a*) and (*b*)). By so doing, the distance between two corner walls 12 in mutual opposition with respect to a center axis can be decreased, thereby forming a waist portion 6. Also, a slim feeling such as that depicted in FIG. 1(*b*) can be imparted when viewed from the direction of the silhouette arrow in FIG. 2(*a*), while providing the external appearance of a square bottle in a front view as shown in FIG. 1(*a*) or in a side view as shown in FIG. 2(*a*).

In an embodiment, the ratio of side wall 11 width, Ws1, to corner wall 12 width, Wc1, at the top end portion and bottom end portion of the trunk portion 4 is about 4:1, typical of previous square bottle-shaped containers. But the ratio of side wall 11 width, Ws2, to corner wall 12 width, Wc2, at waist portion 6 is about 1:1. At waist portion 6, trunk portion 4 approximates an octagon at the planar cross-section.

Approximately flat decompression absorption panels 13, which are surrounded by a step portion 7 in a vertically long shape over approximately the full height range except for the top end portion and the bottom end portion, are formed in a caved-in shape in side walls 11, which have a shape in which the width from the top end portion and the bottom end portion narrows going toward the center height position, in contrast to corner walls 12. Moreover, vertical channel-shaped concave portions 14 are formed in the decompression absorption panels 13 over approximately the full height range at the horizontal center position, and caving deformation proceeds easily and uniformly during decompression with these concave portions 14 as a starting point.

The shape of concave portions 14 is merely illustrative. The skilled artisan would readily understand that other shapes may be utilized to achieve the caving deformations disclosed herein. For example, in one embodiment, the shape design may be a vertical channel shape. In another embodiment, the shape design may be a vertically long oval shape. In yet another embodiment, the shape design may be a vertically long diamond shape. In further embodiments, the shape design may be other shapes as determined by the skilled artisan.

As depicted in FIG. 2(*b*), corner walls 12 are shaped to curve convexly outward in planar cross section, thereby suppressing deformation of corner walls 12 during decompression. The combination of concave portion 14 and the configuration of corner walls 12 facilitates limiting caving deformation to decompression absorption panel 13.

In the absence of limiting decompression to decompression absorption panel 13, corner walls 12 may deform at about the midway height between the top end and bottom end of trunk portion 4, and trunk portion 4 may deform into a flat shape.

Figure 3:
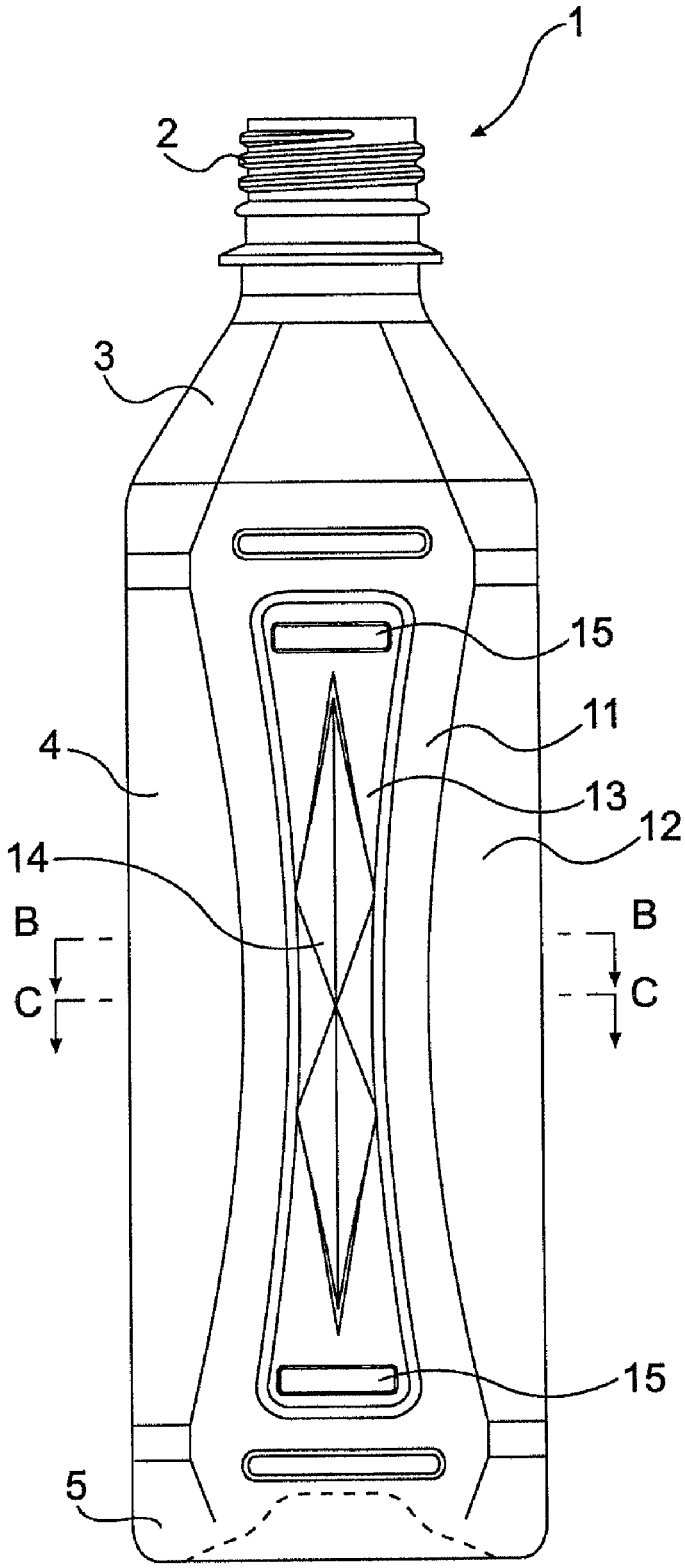
FIG. 3 depicts a front view of another bottle consistent with the embodiments disclosed herein.
Figure 4A:
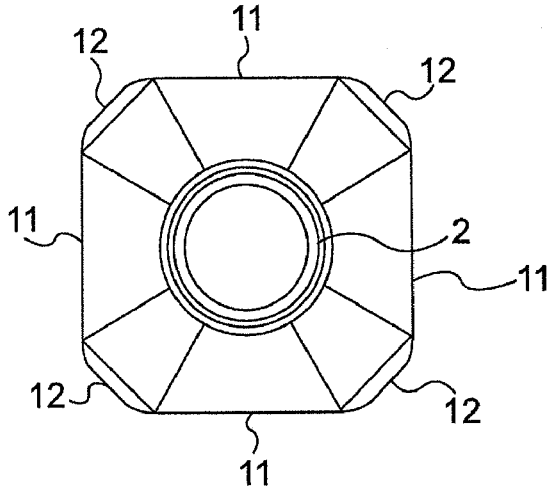
FIG. 4(*a*) depicts a plan view of the bottle depicted in FIG. 3.
Figure 4B:
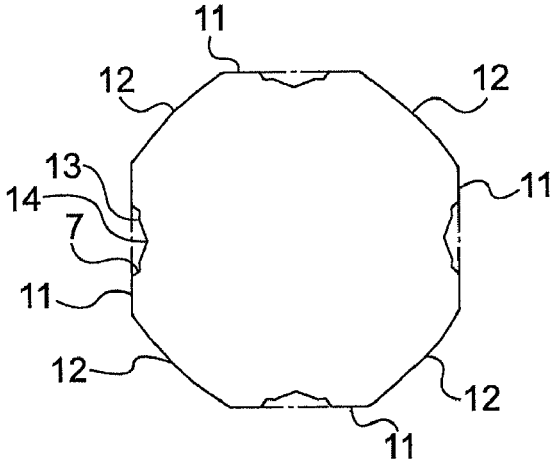
Figure 4C:
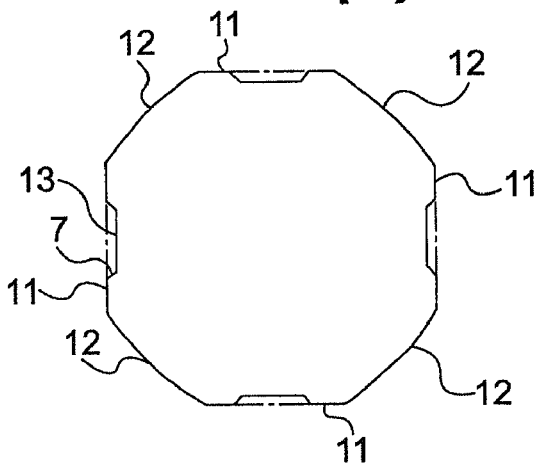
Figure 5:
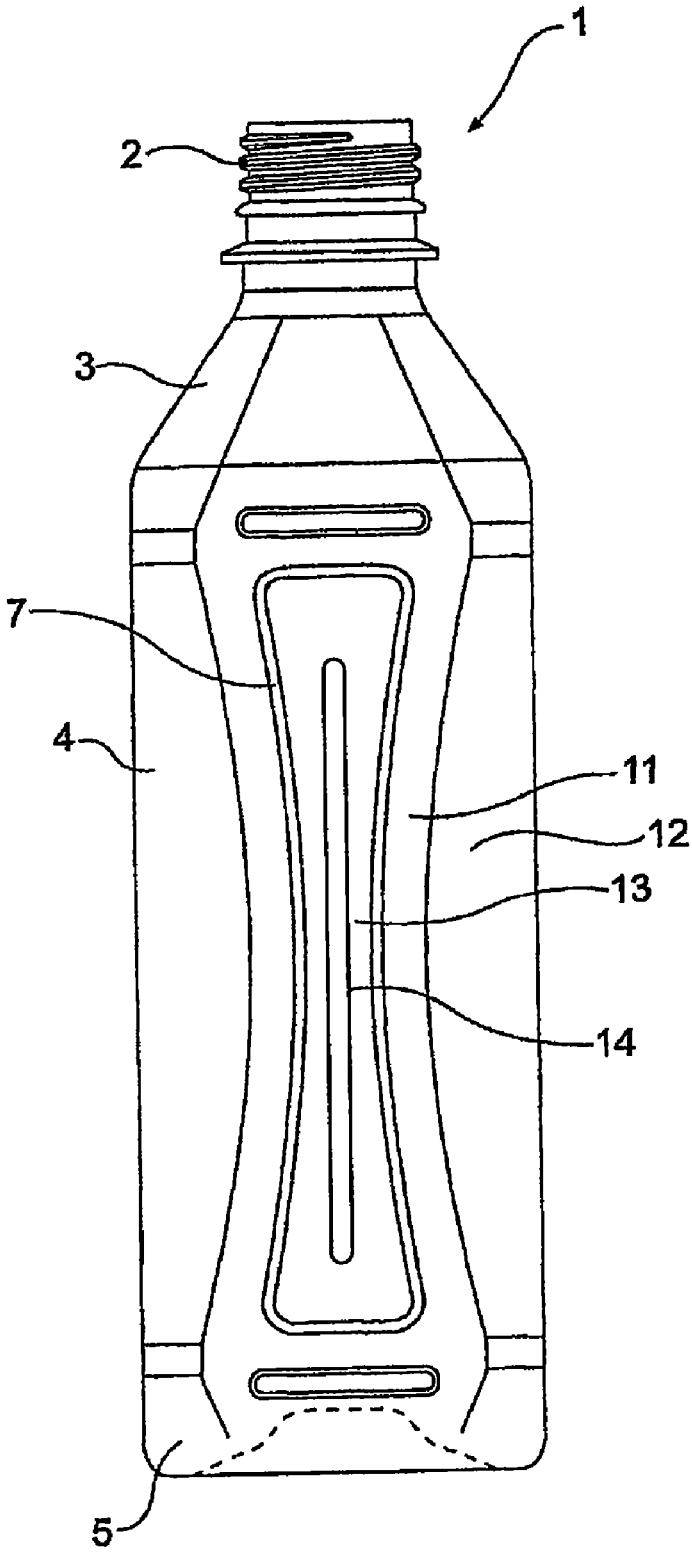
FIG. 5 depicts a front view of another bottle consistent with the embodiments disclosed herein.

FIGS. 3 and 4 depict yet another embodiment of a square bottle-shaped container. In an embodiment, concave portions 14 exhibit a shape approximating vertically long diamond shapes located above the waist portion and below the waist portion. Moreover, the depth of the indentation from the left and right edges to the horizontal center is increased to facilitate the use of the concave portions as the initial starting point of deformation. Furthermore, a horizontal rib 15 is formed on the upper end portion and lower end portion of the decompression absorption panels 13.

By adopting such a shape for concave portions 14, the impression of the bottle's external impression can be changed, while on the functional side this shape can, coupled with the effect of the above-described horizontal rib 15, enable a more effective realization of the suppressing effect on swelling deformations in circumstances such as a high temperature with the content liquid in a filled and sealed state. Also, because concave portions 14 in waist portion 6 are divided in the height direction, the degree of freedom of decompression absorption panel 13 caving deformation can be increased, and the decompression absorption function can be more fully realized.

In another embodiment, the bottle-shaped containers disclosed herein exclude a decompression absorption panel. These containers are useful for storing products in which there is almost no pressure change within the bottle-shaped container.

In yet another embodiment consistent with the container having a decompression absorption panel, a number of variations could be adopted for the shape of the concave portion that serves as the starting point for the caving deformation. Those shapes may take into consideration external appearance, decompression absorption functionality, and absorption functionality for swelling deformations occurring in a filled and sealed state when the liquid contained therein is stored at high temperatures.

Other embodiments will be apparent to those skilled in the art from consideration of the specification and practice of the embodiments disclosed herein. It is intended that the specification and examples be considered as exemplary only.

What is claimed is:

1. A bottle-shaped container comprising a trunk portion and a waist portion, wherein the trunk portion comprises four tabular side walls arrayed about a center axis and four corner walls engaged with said side walls in a corner-cutting form, each corner wall having a width, each side wall having a width, and wherein the width of each corner wall expands from a top end of the trunk portion and from a bottom end of the trunk portion so that the width of each corner wall and the width of each side wall comprise about equal widths at a location about midway between the top end of the trunk portion and the bottom end of the trunk portion.

2. The bottle-shaped container according to claim 1, wherein the distance between two mutually opposing corner walls with respect to the center axis decreases as each corner wall expands.

3. The bottle-shaped container according to claim 1, further comprising a synthetic resin.

4. The bottle-shaped container according to claim 1, further comprising a step portion comprising decompression absorption panels extending from about the top end to about the bottom end.

5. The bottle according to claim 4, further comprising concave portions configured to initially deform when subjected to a decompression force.

6. The bottle-shaped container according to claim 5, wherein the concave portions are located over approximately the full height of the decompression absorption panels.

7. The bottle-shaped container according to claim 1, wherein the corner walls are configured to curve convexly outward when viewed in a planar cross-section.

8. The bottle-shaped container according to claim 4, wherein the corner walls are configured to curve convexly outward when viewed in a planar cross-section.

9. The bottle-shaped container according to claim 5, wherein the corner walls are configured to curve convexly outward when viewed in a planar cross-section.

10. The bottle-shaped container according to claim 5, wherein the concave portions are separately formed above and below the waist portion.

11. The bottle-shaped container according to claim 5, wherein the shape of the concave portion is a vertical channel.

12. The bottle-shaped container according to claim 5, wherein the shape of the concave portion is a vertically long oval.

13. The bottle-shaped container according to claim 5, wherein the shape of the concave portion is a vertically long diamond.

14. The bottle-shaped container according to claim 4, further comprising a horizontal rib configured to suppress outward swelling of the decompression absorption panels.

15. The bottle-shaped container according to claim 1, wherein the ratio of the width of each side wall to the width of each corner wall at the top end of the trunk portion is about 4:1.

16. The bottle-shaped container according to claim 1, wherein the ratio of the width of each side wall to the width of each corner wall at the location about midway between the top end and bottom end of the trunk portion is about 1:1.

17. The bottle-shaped container according to claim 1, wherein the trunk portion comprises a planar cross-section approximating an octagon at the location about midway between the top end and the bottom end of the trunk portion.

* * * * *